US007387383B2

(12) United States Patent
Kan et al.

(10) Patent No.: US 7,387,383 B2
(45) Date of Patent: Jun. 17, 2008

(54) IMAGE FORMING APPARATUS

(75) Inventors: Shoichi Kan, Kanagawa (JP); Yasufumi Tanaami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/778,245

(22) Filed: Jul. 16, 2007

(65) Prior Publication Data

US 2007/0257978 A1 Nov. 8, 2007

Related U.S. Application Data

(62) Division of application No. 10/675,322, filed on Sep. 29, 2003, now Pat. No. 7,347,543.

(30) Foreign Application Priority Data

Sep. 30, 2002 (JP) ..... 2002-287679

(51) Int. Cl.
*B41J 29/13* (2006.01)
*B41J 3/36* (2006.01)

(52) U.S. Cl. ..... 347/109; 347/108

(58) Field of Classification Search ..... 347/108, 347/109, 138, 152, 170, 222; 400/691, 88; 346/143; 358/473
See application file for complete search history.

(56) References Cited

U.S. PATENT DOCUMENTS 5,138,351 A 8/1992 Wiegand et al. ..... 320/111
5,218,188 A * 6/1993 Hanson ..... 235/375
5,446,783 A 8/1995 May ..... 455/557
5,479,486 A 12/1995 Saji ..... 455/573
5,898,932 A 4/1999 Zurlo et al. ..... 455/573
6,236,486 B1 5/2001 Nocker, IV ..... 398/129
6,241,351 B1 6/2001 Stephenson ..... 347/109
6,255,800 B1 7/2001 Bork ..... 320/115
6,290,349 B1 9/2001 Silverbrook et al. ..... 347/87
6,382,761 B1 5/2002 Asano et al. ..... 347/19
6,742,887 B2 6/2004 Ando ..... 347/109

* cited by examiner

*Primary Examiner*—Stephen Meier
*Assistant Examiner*—Leonard S Liang
(74) *Attorney, Agent, or Firm*—Morgan & Finnegan, LLP

(57) ABSTRACT

An image forming apparatus is featured with excellent operability of storage at the time of non-use, as well as excellent operability of charging the battery, in addition to such advantages as thin and battery-driven, and preferably suitable for portable use. A cradle provided for this image forming apparatus functions as a placement stand when an ink jet printer, which is provided with a battery charger mounted thereon, is inserted in the direction designated appropriately at the time of non-use. When the ink jet printer having the battery charger thus mounted thereon is contained in the cradle, the contact point portion of the battery charger and the contact terminal portion of the cradle are electrically connected. Therefore, the battery incorporated in the battery charger is charged when the AC adopter cable is inserted into the CDL-DCin jack of the cradle.

2 Claims, 9 Drawing Sheets

IMAGE FORMING APPARATUS

This is a divisional of prior application Ser. No. 10/675,322, filed Sep. 29, 2003, which is hereby incorporated by reference in its entirety as if fully set forth herein.

This application claims a benefit of foreign priority based on Japanese Patent Application No. 2002-287679, filed on Sep. 30, 2002, which is hereby incorporated by reference herein in its entirety as if fully set forth herein.

BACKGROUND OF THE INVENTION

1. Field of the Invention

The present invention relates to an image forming apparatus. More particularly, the invention relates to a portable thin image forming apparatus, which can be driven by use of a battery.

2. Related Background Art

The ink jet recording apparatus, which is widely known as an image forming apparatus, has been utilized for a printer and a copying machine, because the apparatus operates with less noise and lower running cost, and can be made compact and adaptable for color use, among some other advantages.

Also, in recent years, along with the downsizing of computers, a portable computer of note type and the like have been in wide use. Then, along with this trend, a small image forming apparatus has been designed with the principal object of providing portability.

As the requirements of an image forming apparatus for portable use, it has been particularly important that the apparatus can be held (handled) easily; the apparatus is thin so that it can be held in a bag or the like appropriately; and it should be battery driven, and easily chargeable, among some others.

To meet such requirements, it has been practiced to market as a product for portable use a thin note type printer, which is used by installing a battery charger with a battery incorporated therein.

However, in order to avoid taking a large space for storage at the time of non-use, a thin type printer of the kind is placed so as to be substantially vertical (called "vertical placement") from the direction almost in parallel with the plane in which the flat housing of the printer is placed (called "horizontal placement"), it causes lack of stability, because the apparatus is thin. Therefore, there is a need for handling the printer carefully for the placement with a good balance or there is a need for another action such as to spread a footing member for enabling the installation area to be expanded for obtaining stability.

Also, when a battery should be charged, a source-supply cable, such as an AC adopter, is inserted into a printer main body or a charger is mounted on the printer main body. Then, it is necessary to remove the source-supply cable, which has been connected, when the apparatus is carried after electricity has been charged. The structure is not arranged appropriately to effectuate charging with ease for portable use.

SUMMARY OF THE INVENTION

The present invention is designed in consideration of the situations as discussed above. It is an object of the invention to provide an image forming apparatus excellent in operability in the storage at the time of non-use, and also, excellent in operability in charging the battery, in addition to such advantages as thin and battery-driven, and preferably suitable for portable use.

In order to achieve the aforesaid object, the image forming apparatus of the present invention is made capable of being contained in a separate container stand (hereinafter referred to as a "cradle") serving as a placement stand.

The image forming apparatus is used in a mode of horizontal placement at the time of forming images, and capable of being contained in a mode of vertical placement at the time of non-use adopting the mode having the apparatus to be contained in the cradle.

The image forming apparatus further comprises a battery, and charging means for charging the battery, and it is preferable to conduct the charging of the battery by containing the apparatus in the cradle at the time of non-use.

The battery and the charging means are incorporated in a charging device structured to be attachable to and detachable from the image forming apparatus, and it is preferable to conduct the charging of the battery by containing in the cradle the charging device in the status of being mounted on the image forming apparatus.

On the backside of the charging device, the contact point portion is provided, and the contact terminal portion is provided for the cradle, and it is preferable to connect the contact point portion and the contact terminal portion electrically by containing the image forming apparatus having the charging device mounted thereon in the cradle.

The contact point portion of the charging device, and the contact terminal portion of the cradle are arranged in the central portion of the connecting surface of the charging device and the cradle, respectively, and are preferably are in a symmetrical mode.

The aforesaid cradle is provided with a shutter mechanism for protecting the contact terminal portion, and it is preferable to retract the shutter mechanism by containing in the cradle the image forming apparatus having the charging device mounted thereon.

It is preferable to make the load required for pressurizing the contact terminal portion to be in contact and retracting the shutter mechanism smaller than the weight of the charging device alone.

For the image forming apparatus, the charging device is provided with a portion to hide the DC jack for input use, and when the image forming apparatus having the charging device mounted thereon is contained in the cradle, the structural portion of the cradle preferably covers the jack for DC input use of the charging device.

Also, in place of the mode of the image forming apparatus described above, it may be possible to incorporate the battery in the image forming apparatus, and the charging means is incorporated in the cradle, and the battery is charged when the image forming apparatus is contained in the cradle.

In another mode described above, it is preferable that on the backside of the image forming apparatus the contact point portion is provided, and the contact terminal portion is provided for the cradle, and the contact point portion and the contact terminal portion are electrically connected by containing the image forming apparatus in the cradle.

In another mode described above, it is preferable that the contact point portion of the image forming apparatus and the contact terminal portion of the cradle are arranged in the central portion of the connecting surface of the charging device and the cradle, respectively, and are in a symmetrical mode.

In another mode described above, it is preferable that the cradle is provided with a shutter mechanism for protecting the contact terminal portion, and the shutter mechanism retracts by containing the image forming apparatus in the cradle.

In this case, it is preferable to make the load required for pressurizing the contact terminal portion to be in contact and retracting the shutter mechanism smaller than the weight of the image forming apparatus.

Also, each of image forming apparatuses of various modes described above is provided with indication means for showing the charging condition of the battery either for the charging device or the image forming apparatus, and it is preferable to structure the indication means to be recognizable even when the image forming apparatus is contained in the cradle.

It is also preferable to make the indication means for showing the charging condition of the battery recognizable even when the image forming apparatus is contained in the cradle in any direction, forward or backward, and to make the contact point portion and the contact terminal portion electrically connectable.

It is preferable to structure a recording sheet supply tray, which dually functions as a cover capable of being open and closed with respect to the image forming apparatus, not to open when the image forming apparatus is contained in the cradle.

It is preferable to make the image forming apparatus containable in the cradle in the status of having an I/F cable connected thereto.

It is preferable to arrange on the inner floor surface of the cradle the elastic member that supports the feet of the charging device or image forming apparatus to be contained in the cradle.

It is preferable to make the installation area of the cradle to the floor surface is larger than the installation area of the image forming apparatus to be contained in the cradle.

It is preferable to arrange each mode of the image forming apparatuses described above to be thin having a thickness of three inches or less.

It is preferable to arrange for each mode of the image forming apparatuses described above image forming means serving as a recording head for forming images by discharging ink.

In accordance with the structures described above, it is possible to provide an image forming apparatus excellent in operability at the time of storing and charging battery with the full utilization of advantages such as thin and battery-driven preferably suitable for portable use.

DETAILED DESCRIPTION OF THE PREFERRED EMBODIMENTS

Hereinafter, with reference to the accompanying drawings, the description will be made of the embodiments in accordance with the present invention.

Figure 1:
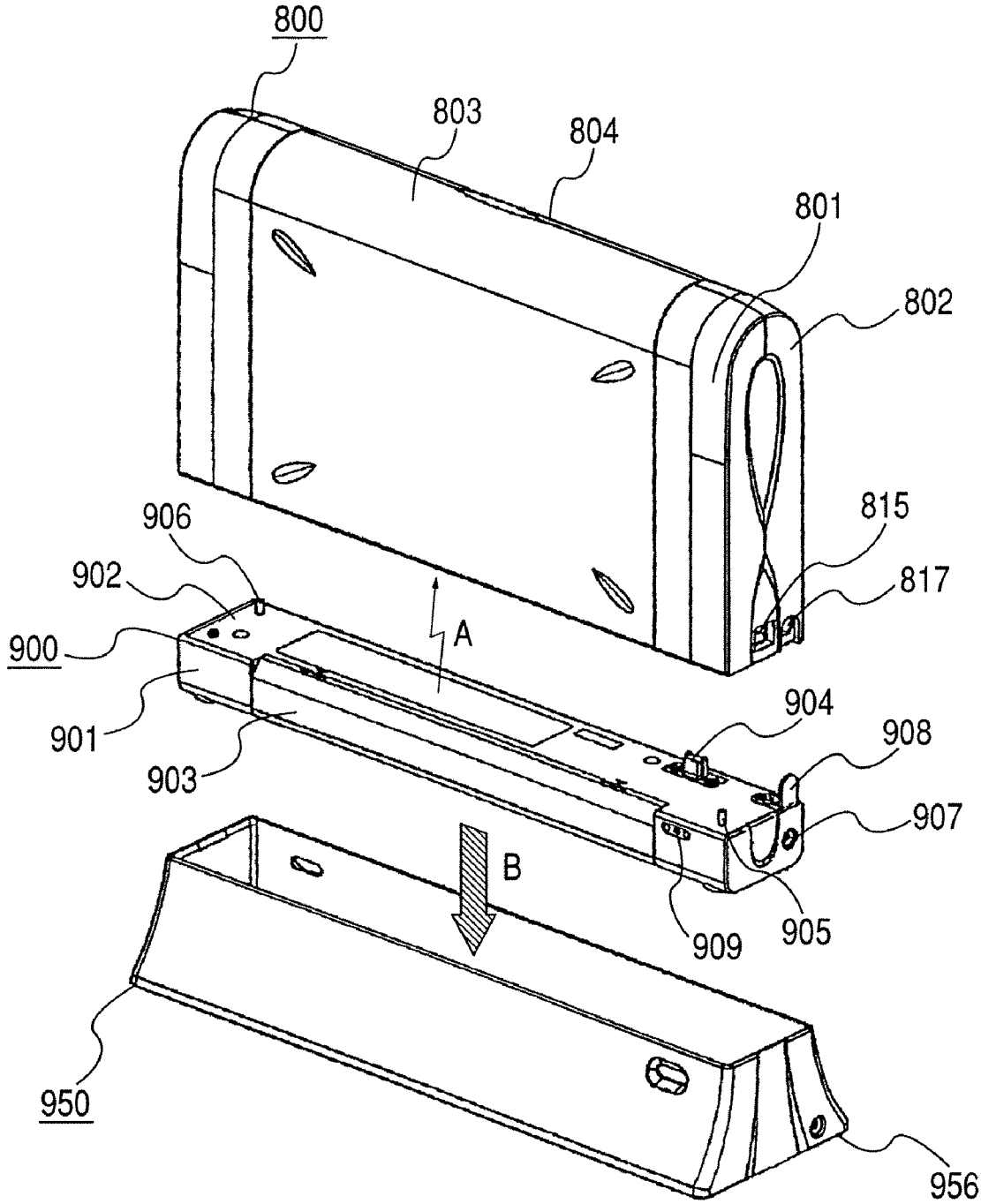
FIG. 1 is a perspective view that shows the entire structure of an ink jet printer, which is one embodiment of the image forming apparatus of the present invention.

FIG. 1 is a perspective view that shows the entire structure of an image forming apparatus embodying the present invention. There are represented in it, the ink jet printer serving as an image forming apparatus, the battery charger, which is a charger detachably mountable on the printer main body, having a battery incorporated therein, and the cradle, which serves as the placement stand that contains both of them vertically when mounted. In this respect, the description is made using paper as a recording medium used for recording by this ink jet printer, for example. However, any type of medium may be usable if only the medium is of sheet type capable of being recorded.

In FIG. 1, the outer appearance of the ink jet printer 800 is a shell structure formed by an upper case 801, a lower case 802, a sheet-feeding cover 803, and a cover of sheet-expeller port 804, and then, the printer takes this mode when it is not in use (on the placement stand, being carried, or the like). Also, on the side face of the ink jet printer 800, there are arranged a DCin jack (the jack for use of DC supply source input) 817 where the AC adopter cable serving as the power supply source is inserted, and an I/F connector (interface connector) 815 for connecting USB cable. The sheet feeding cover 803 functions as the recording sheet-supplying tray on which recording sheet, such as paper, is stacked when the tray is open with respect to the printer main body for the execution of recording.

Figure 3:
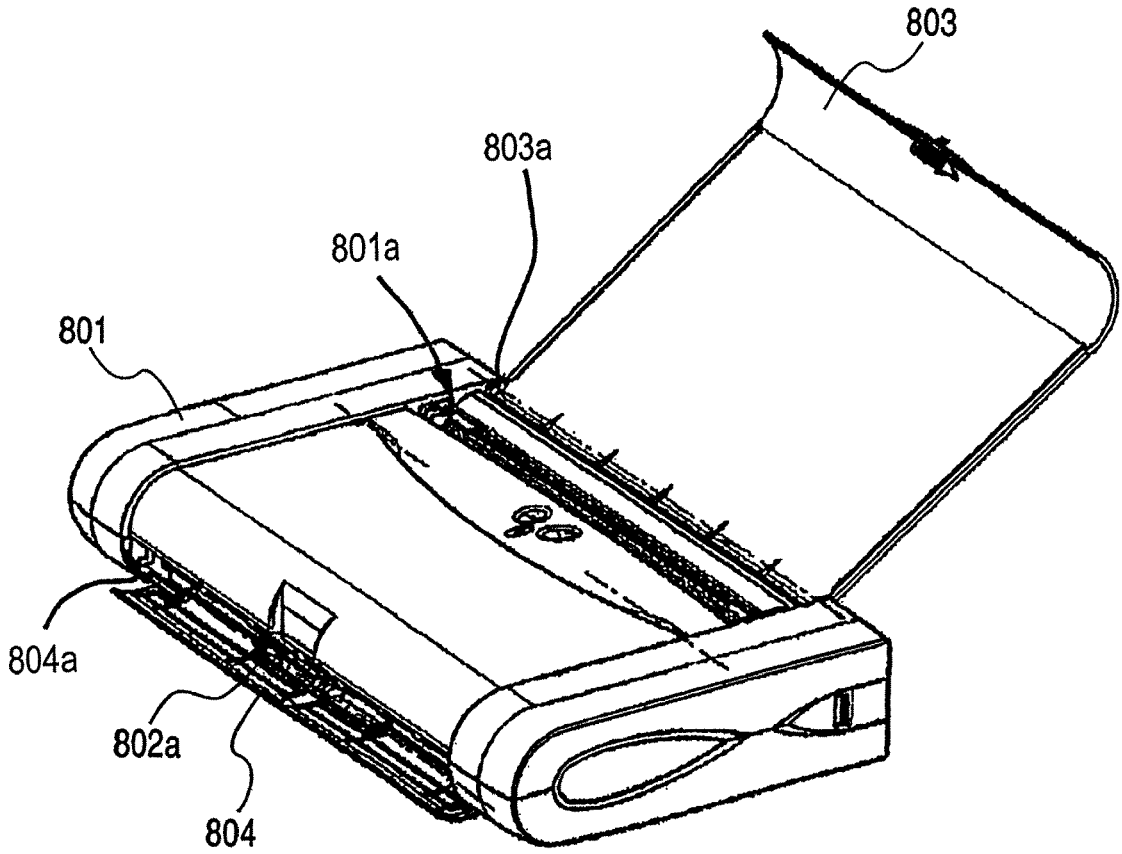
FIG. 3 is a perspective view that shows the ink jet printer represented in FIG. 1, which is in use.

FIG. 3 is a perspective view observed from above on the right front side, and shows the statue of the printer main body 800, which is in use. In the status shown in FIG. 1, the sheet feeding opening portion 801*a* is covered by the sheet feeding cover 803, and also, the sheet expeller port 802*a* is covered by the sheet expeller port cover 804, respectively. In this status, it is arranged to prevent dust particles and foreign substances described earlier from entering the inside of the printer main body 800.

The sheet feeding cover 803 is made rotative centering on the rotational shaft 803*a* with respect to the printer main body 800, and by means of a stopper (not shown), it stops at a specific angle optimally given to feeding a sheet, and support the sheet feeding. In this manner, the precision of sheet feeding is enhanced. The sheet expeller port cover 804 rotates centering on the rotational shaft 804*a* and releases the sheet expeller port 802*a*.

Figure 4:
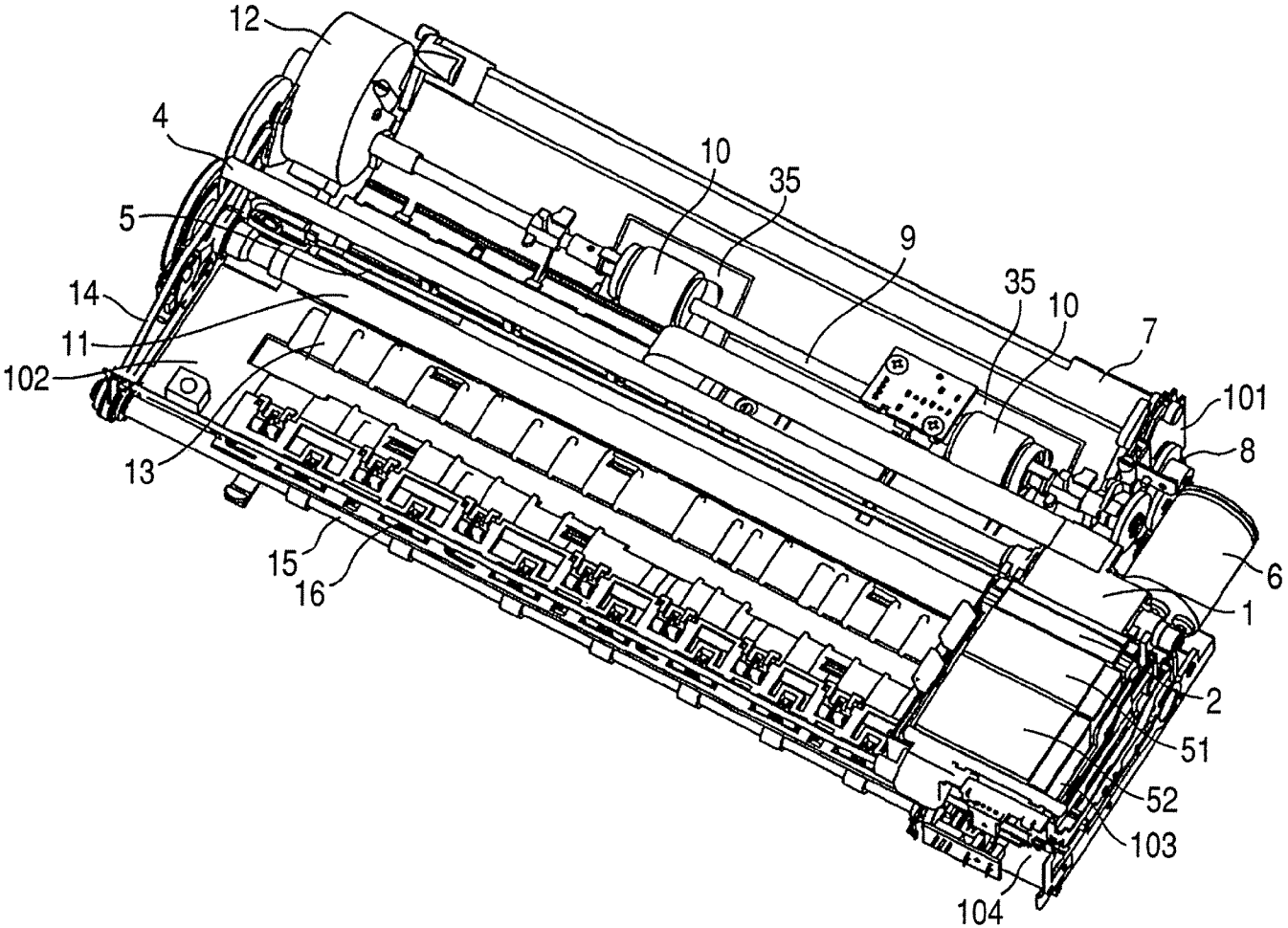
FIG. 4 is a perspective view that shows the inner structure of the ink jet printer represented in FIG. 1 entirely.

FIG. 4 is a perspective view that sows the inner structure of the ink jet printer entirely.

In FIG. 4, the ink jet printer is structured with sheet material feeding means 101; sheet material conveying means 102; printing means 103; and recovering means 104.

The sheet material, which is stacked on a pressure plate 7 of sheet material feeding means 101 is let out and fed into conveying means 102 having a sheet-feeding roller rubber 10 provided therefor by use of a feet-feeding roller 9 driven by a sheet-feeding motor 8. Further, the sheet material is conveyed onto to a platen 13 by the conveying roller 11, which is driven by the conveying motor 12 of conveying means 102.

On the sheet material conveyed onto the platen 13, printing is made by the printing head 2, which is mounted on the carriage 1 of printing means 103 having ink tank 51 and 52 mounted thereon. The carriage 1 reciprocates along the guide shaft 4 with the driving power of the carriage motor 6, which is transmitted thereto by way of a carriage belt 5.

After printing is over, the sheet material is let out by the conveying roller 11 to a sheet expeller roller 15, and nipped between a spur 16 and the sheet-expeller roller to be expelled. The sheet-expeller roller 15 is driven by the driving power of the conveying motor 12, which is transmitted thereto by way of a sheet-expeller belt 14.

Recovering means 104 is provided for the purpose of recovering the clogging of the printing head and others so as to maintain the printing status in good condition, which is structured with pumping means (not shown), capping means (not shown), and wiping means (not shown).

Next, it is arranged to form a battery charger 900 with a main case 901, a cover case 902, and a battery 903 to present the outer appearance thereof. The battery 903, which serves as the battery charger, is made removable.

Also, on the installation surface (connecting surface) of the battery charger 900 to the ink jet printer 800, there are arranged the connector 904, which is used for electrical connection, and the fixing screws 905 and 906, which are used for the mechanical installation and fixation. Then, with the connection of the printer main body in the direction indicated by an arrow A in FIG. 1, the battery driving is made possible. Further, on the ceiling face of the battery charger 900, a charge-indication unit 909 is arranged to indicate the charging condition of the battery. On the side face of the battery charge 900, there are arranged the CHG-DCin jack 907, into which is inserted the AC adopter cable that serves as the power supply, and a blind plate 908, which covers the DCin jack 817 of the ink jet printer 800 when the battery charger 900 is mounted.

The cradle 950 functions a placement stand when it is inserted in the direction indicated by an arrow B in FIG. 1 in the status where the battery charge 900 is mounted on the ink jet printer 800.

Figure 2:
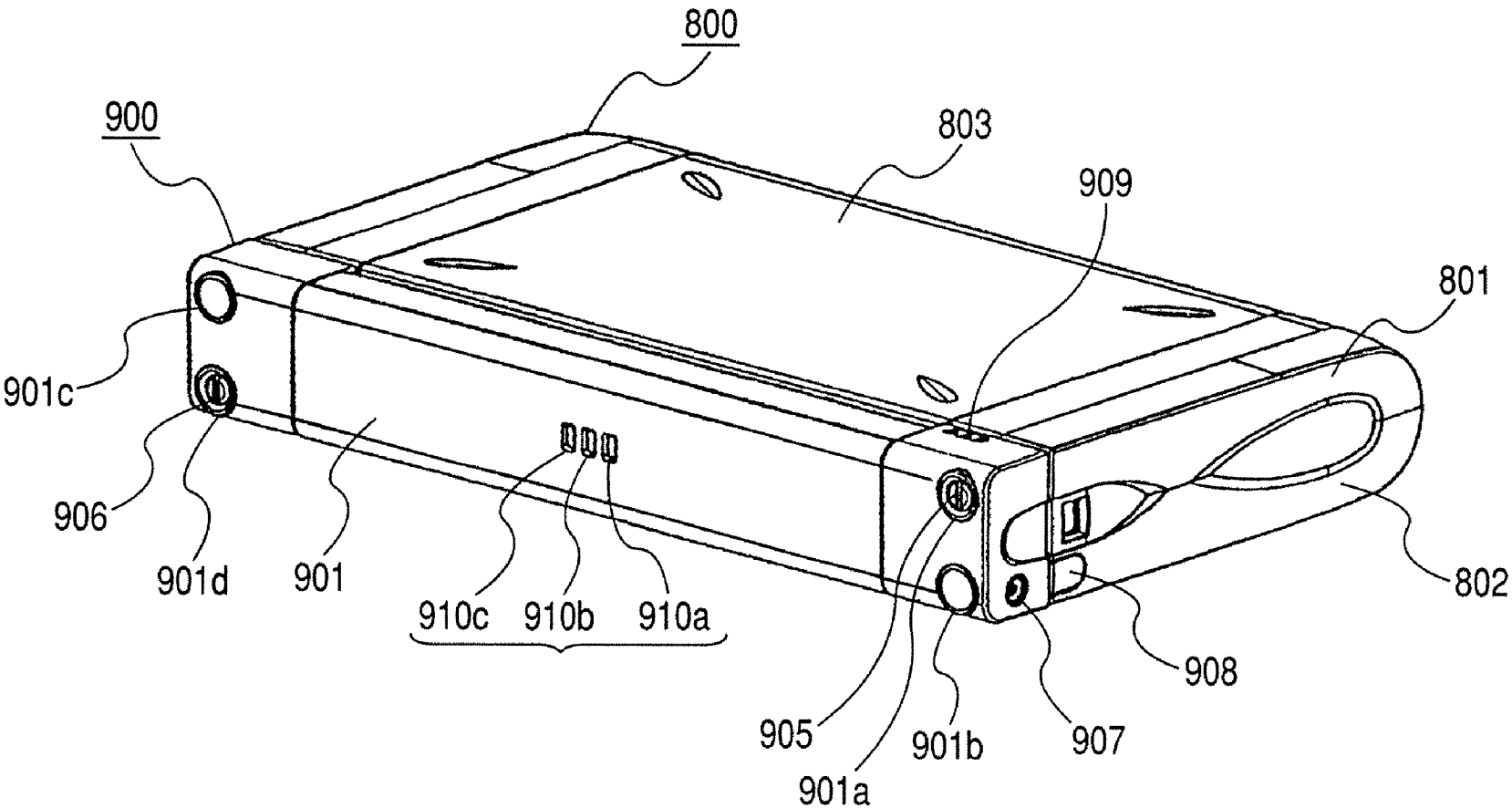
FIG. 2 is a perspective view that shows the status of a battery charger being mounted on the ink jet printer represented in FIG. 1.

FIG. 2 is a perspective view that shows the status where the battery charge 900 is mounted on the ink jet printer 800 when the printer ceiling face side is observed from diagonally above, and also, from the backside of the printer.

As shown in FIG. 2, the battery charge 900 is mounted on the backside of the ink jet printer 800, and when fixed by use of the fixing screws 905 and 906, the battery driving is made possible.

Also, as described earlier, with the blind plate 908 provided for the battery charger 900, it is structure to cover the DCin jack 817 of the ink jet printer 800. Therefore, it is made possible for the user to insert the AC adopter cable into the CHG-DCin jack 907 side of the battery charger 900 without any errors when the battery charger 900 is mounted, thus preventing any erroneous insertion thereof.

On the backside of the battery charger 900, there are arranged four feet portions 901*a*, 901*b*, 901*c*, and 901*d* provided for the main case 901. Also, on the same backside, contacts 910*a*, 910*b*, and 910*c* are provided in order to effectuate electrical contacts when mounted on the cradle 950.

Further, as shown in FIG. 2, the charging indication unit 909 of the battery charger 900 is arranged in a position on the ceiling face easily recognizable when the ink jet printer 800 is mounted and used, and the recognition of eyesight thereof is not shielded when the sheet feeding cover 803 is open.

Figure 5:
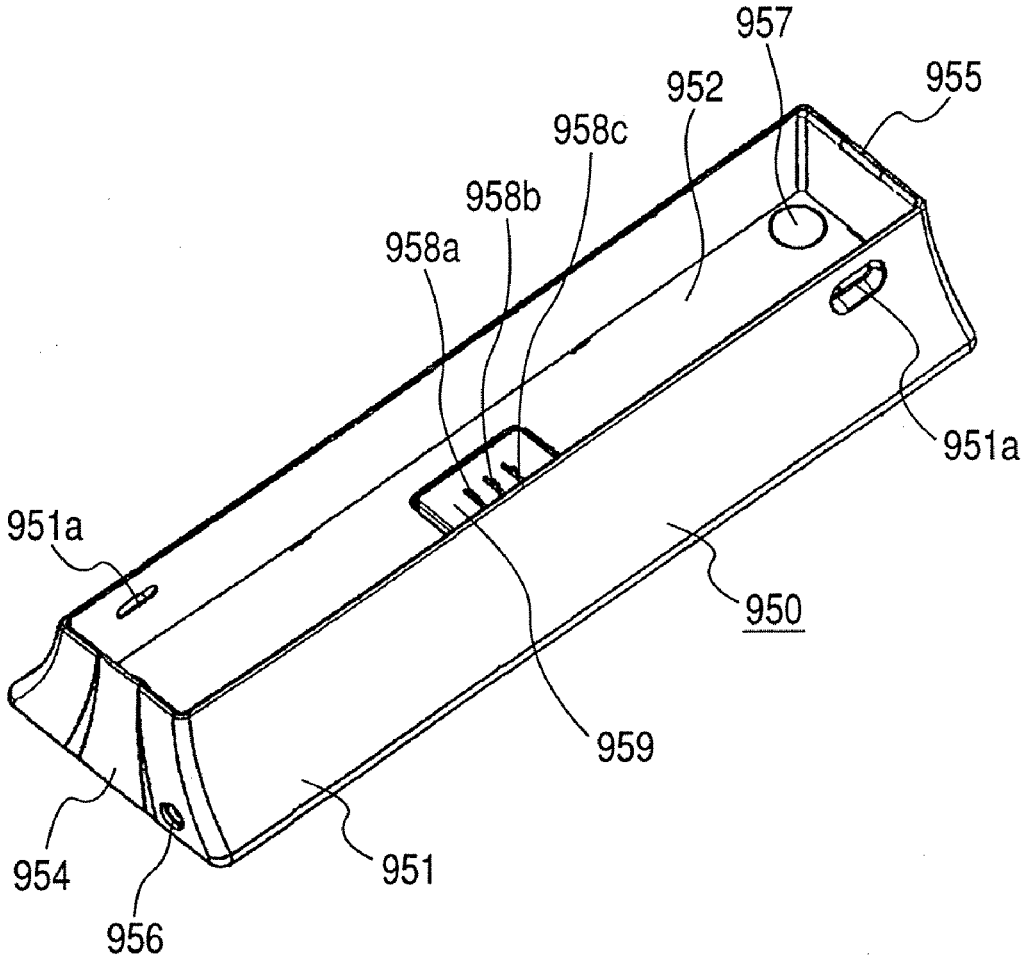
FIG. 5 is a perspective view that shows the cradle structure that contains the ink jet printer represented in FIG. 1.

FIG. 5 is a perspective view that sows the structure of the cradle 950.

In FIG. 5, it is arranged to structure the cradle 950 with an upper case 951, a flowing member 952, a bottom case 953 (not shown in FIG. 5), and CDL ornamental plates 954 and 955 to present the outer appearance thereof. On the outer circumferential side face of the upper case 951, there are arranged the CDL-DCin jack 956 for inserting the AC adopter cable serving as the power supply, and the windows 951*a* and 951*b* for making the eyesight recognition of the charging indication unit 909 possible for the battery charger 900 even when the printer is contained into the cradle 959.

Also, on the flooring member 952 inside the cradle 950, the CDL rubber feet 957 (in FIG. 5, three locations are not shown) that support the feet portions 901*a*, 901*b*, 901*c*, and 901*d* (FIG. 2) of the battery charger 900 are arranged to face each other when the ink jet printer 800 having the battery charge 900 mounted thereon is contained in the cradle. Further, inside the cradle 950, the contact terminals 958*a*, 958*b*, and 958*c*, which are electrically in contact with the contact points 910*a*, 910*b*, and 910*c* of the battery charger 900, and the shutter member 959 that protects them is arranged. The shutter member 959 usually ascends to the position where the tips of the contact terminals 958*a*, 958*b*, and 958*c* are hidden, and when the ink jet printer 800 having the battery charge 900 mounted thereon is contained in the cradle 950, the shutter member descends to the position where the tips of the contact terminals 958*a*, 958*b*, and 958*c* appear (FIG. 5 shows the status in which the shutter member descends). In this respect, the number of contact points of the battery charger 900 and the number of the contact terminals of the cradle 950 are not necessarily limited to those of the present embodiment.

Further, as shown in FIG. 5, the contact points 910*a*, 910*b*, and 910*c* of the ink jet printer 800, and the contact terminals 958*a*, 958*b*, and 958*c* of the cradle 950 are arranged on the central portion of the contact surface between the ink jet printer 800 and the cradle 950, respectively. Then, the contact points 910*a*, 910*b*, and 910*c*, and the contact terminals 958*a*, 958*b*, and 958*c* are arranged with symmetrical relations so as to make the electrical connections in the correct arrangement thereof irrespective of the status whether the batter charger 900 is orientated forward or backward when it is contained in the cradle 950. Moreover, the windows 951*a* and 951*b* of the upper case 951 are arranged in the symmetrical positions for the charging indication unit 909 of the battery charger 900. As a result, the user can contain the ink jet printer 800 in the cradle 950 in the forward direction or backward direction without any functional drawback, and charging is made possible.

When the battery charger 900 is contained in the cradle 950 in a status where it is orientated forward or backward, the contact point 910*b* is connected with the contact terminal 958*b*.

Also, the inside of the contact terminals 958*a* and 958*c* is conducted with the same polarity. Likewise, the contact points 910*a* and 910*c* are conducted. Therefore, being in contact with either the contact terminal 958*a* or 958*c*, the contact points 910*a* and 910*c* make correct connection.

Figure 6A:
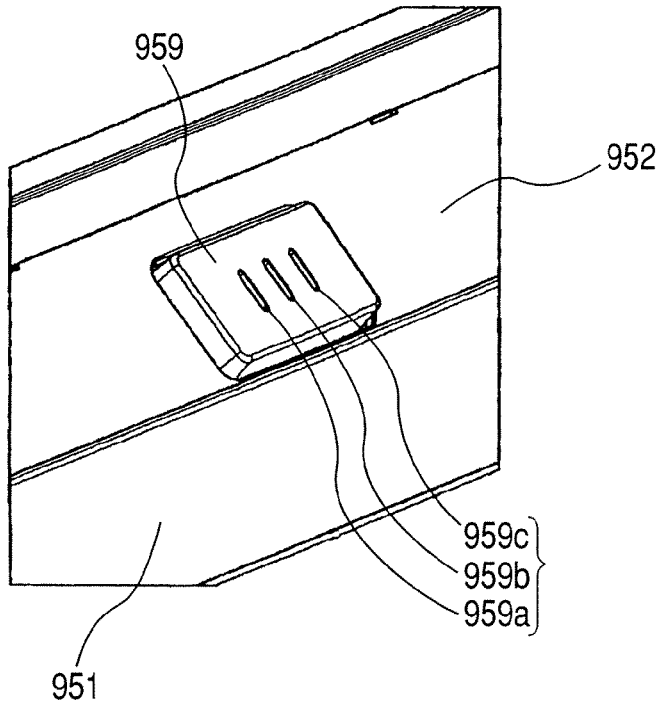
FIGS. 6A and 6B are enlarged perspective views that illustrate the operation of the shutter member of the cradle represented in FIG. 5.
Figure 6B:
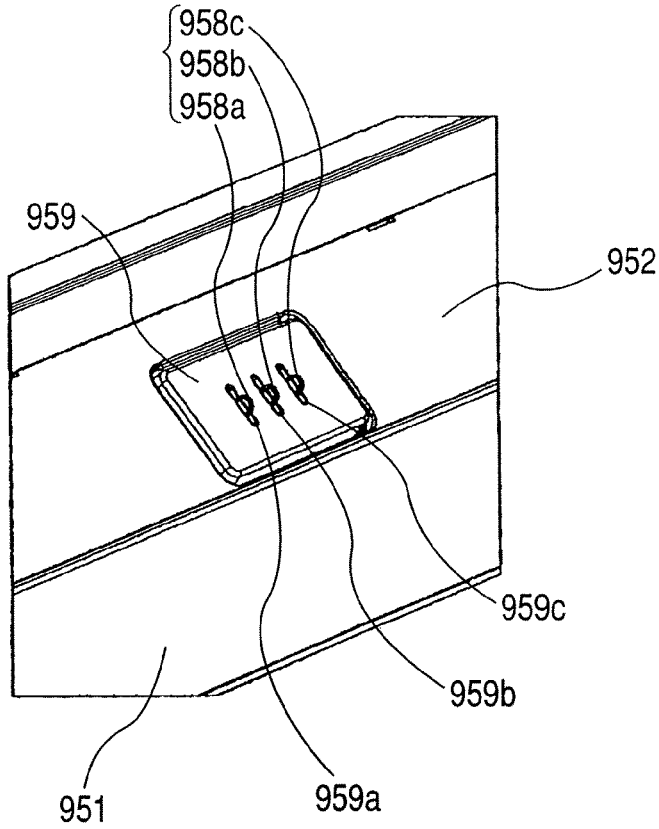

FIGS. 6A and 6B are enlarged perspective views that illustrate the operation of the shutter member 959 of the cradle 950. FIG. 6A shows the statue where the shutter member 959 ascends. FIG. 6B shows the status where the shutter member 959 descends.

As shown in FIG. 6A, the shutter member 959 ascends to the position to completely hide the contact terminals 958*a*, 958*b*, and 958*c* in the status where the cradle 950 does not contain anything, thus preventing these contact terminals from being broken or any other damages. When the ink jet printer 800 is contained in the cradle 950, the shutter member 959 descends so as to present the condition as shown in FIG. 6B, and the contact terminals 958*a*, 958*b*, and 958*c* are exposed from the slits 959*a*, 959*b*, and 959*c* provided for the shutter member 959, thus conditioning the contact points 910*a*, 910*b*, and 910*c* to make electrical connection.

Also, the biasing force that enables the shutter member 959 to ascend to the usual position is set at a value smaller than the weight of the single body of the battery charger 900, not to mention the ink jet printer 800. Therefore, even in a case where only the battery charger 900 is contained in the cradle 950, the structure is arranged so that the contact points 910*a*, 910*b*, and 910*c* can be electrically connected with the contact terminals 958*a*, 958*b*, and 958*c*.

Figure 7:
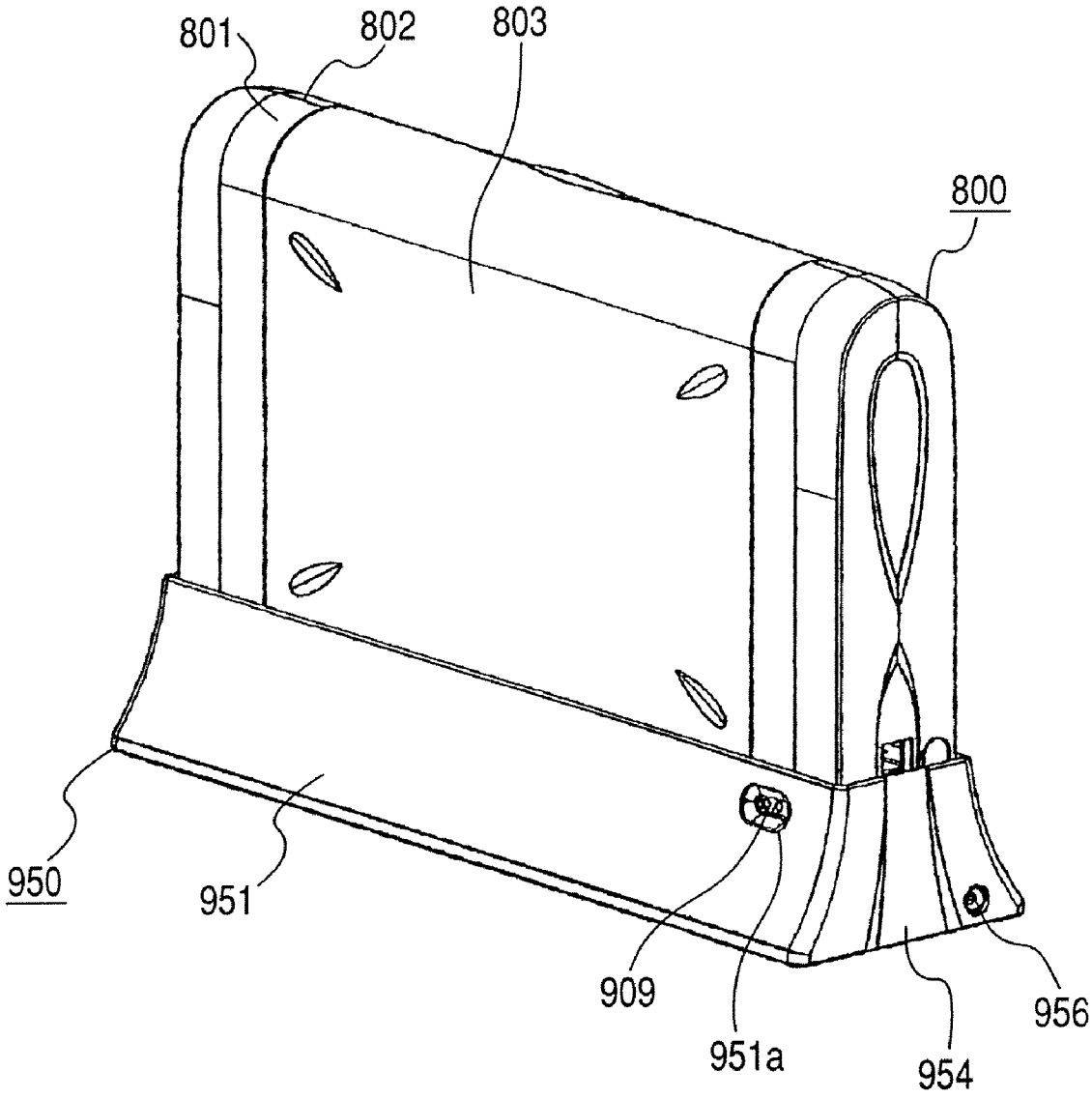
FIG. 7 is a perspective view that shows the status where the ink jet printer having the battery charger mounted thereon as in FIG. 1 is contained in the cradle.

FIG. 7 is a perspective view that shows the status where the ink jet printer 800 having the battery charge 900 mounted thereon is contained in the cradle 950.

In the status shown in FIG. 7, the contact points 910 of the aforesaid battery charger 900 and the contact terminals 958 of the cradle 950 are electrically connected. Therefore, when the AC adopter cable remains to be inserted into the CDL-DCin jack 956 of the cradle 950, the battery incorporated in the battery charger 900 is charged.

As shown in FIG. 7, in the status where the ink jet printer 800 is contained in the cradle 950, the upper case 951 is structured to cover the CHG-DCin jack 907 of the battery charger 900. As a result, the user can insert the AC adopter cable into the CDL-DCin jack 956 side of the cradle 950 correctly when the cradle 950 is used, thus preventing any erroneous insertion thereof.

Also, the charging indication unit 909 of the battery charger 900 is structured to be visible through the window 951*a* provided for the upper case 951 of the cradle 950. Consequently, it is possible to confirm the charged condition of the battery as it is contained in the cradle 950.

Figure 9:
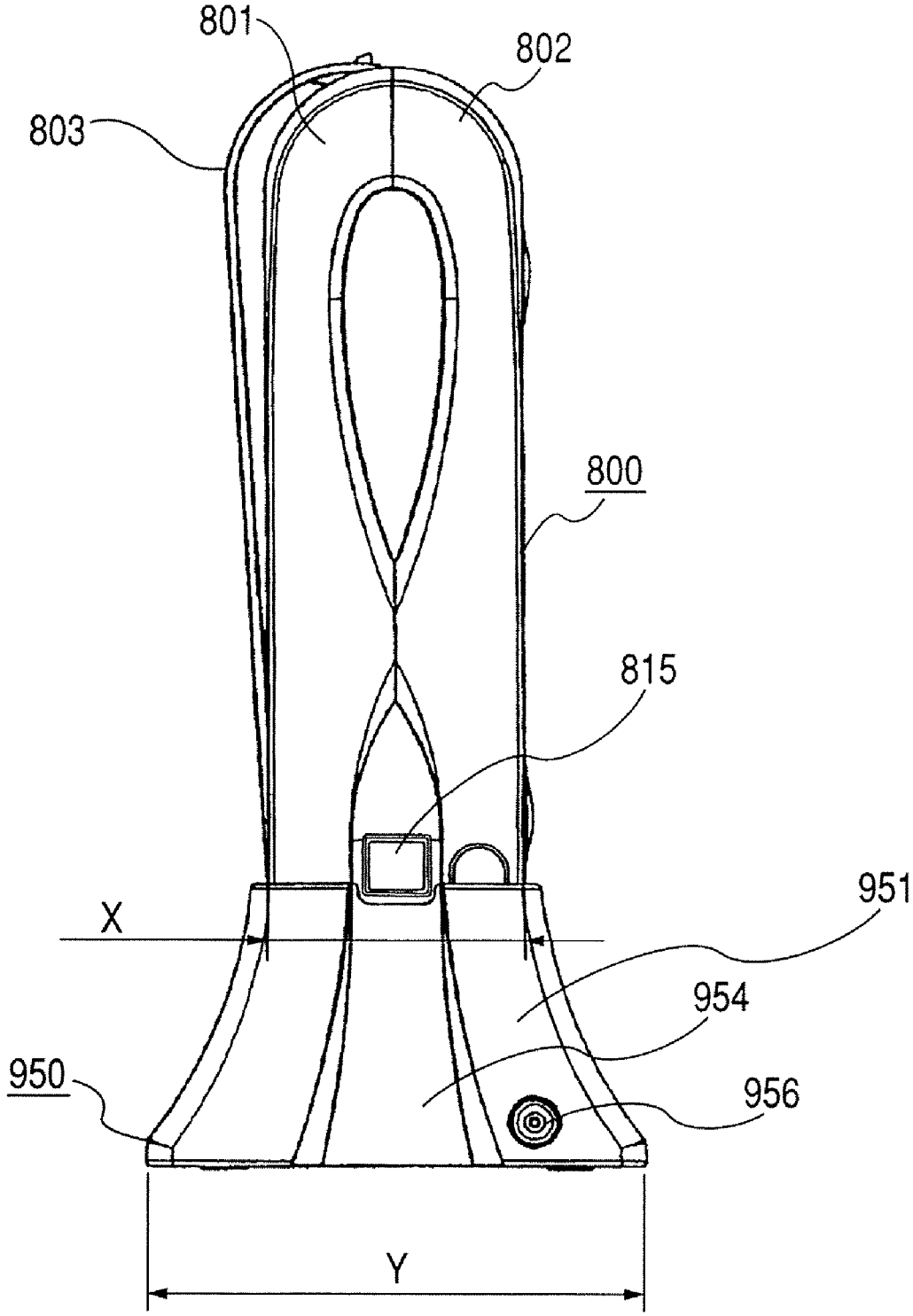
FIG. 9 is a side view that shows the status where the ink jet printer having the battery charged mounted thereon as shown in FIG. 7 is contained in the cradle.

Also, FIG. 9 is a side view that shows the ink jet printer 800 contained in the cradle 950 with the battery charger 900 mounted thereon as shown in FIG. 7.

As sown in FIG. 9, in the status where the ink jet printer 800 is contained in the cradle 950, the structure is arranged to support it in a position where the sheet-feeding cover 803 is not released. In other words, when the ink jet printer 800 is contained in the cradle 950, the sheet-feeding cover 803 is placed inside the upper case 951 of the cradle 950 so as to regulate the open and closing operation of the sheet-feeding cover 803. Therefore, it becomes possible to prevent the sheet-feeding cover 803 from being open or falling off erroneously during the charging of batter or the like.

Also, in FIG. 9, the upper case 951 and the CDL ornamental plate 954 are structured so as to enable the I/F connector 815 of the ink jet printer 800 to be completely exposed in the status where it is contained in the cradle 950. Therefore, even if the USB cable is inserted into the ink jet printer 800, which is contained in the cradle 950 as it is, there is no interference between the cradle 950 and the cable, and it is unnecessary to remove the USB cable at each time when the printer is contained. There is no possibility that the connector portions are damaged, either. In this respect, it may be possible to use a printer having wireless communication means, such as light or electric waves, provided therefor in a location where such means is exposed from the cradle 950 when the ink jet printer 800 of the kind is contained.

Further, as shown in FIG. 9, The shape of the cradle 950 is formed so that the relations between the width X of the opening portion that receives the ink jet printer 800 (that is, the width of installation surface of the ink jet printer 800 when it is placed vertically), and the width Y of the installation surface of the cradle 950 to the floor surface are made to be X<Y. As a result, as compared with the case where the ink jet printer 800 is placed vertically alone, the stability becomes far greater when it is vertically placed after being contained in the cradle 950. Therefore, there is no need any longer for careful handling when it is placed vertically by itself or no need for expanding or holding the foot member by some other action for obtaining the expanded installation area in order to secure stability, and the attachment and detachment are made with ease.

In accordance with the embodiment so far, the description has been made of the structure in which it is made possible to charge a battery by containing in a cradle having only energizing function a charging device attachable to and detachable from the printer main body having the battery incorporated therein, and an ink jet printer having the charging device mounted thereon. However, the present invention is not necessarily limited to such structure.

In other words, as another embodiment, it may be possible arrange the structure so that a printer having a battery incorporated therein is contained in a cradle having charging means therefor. Further, it may be possible to arrange the structure so that a printer having a battery and charging means incorporated therein is contained in a cradle having only energizing function therefor.

Figure 8:
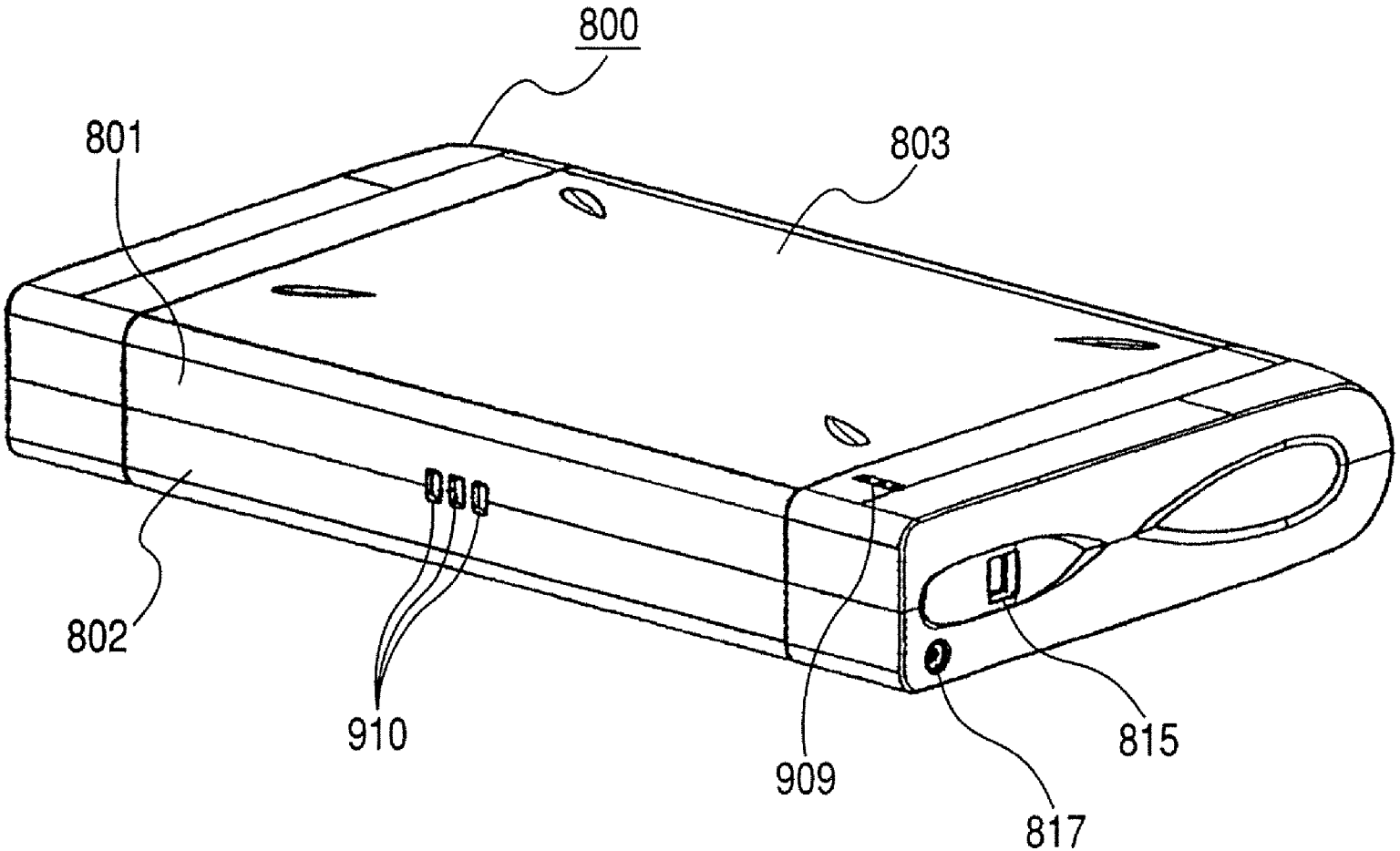
FIG. 8 is a perspective view that shows the printer having the battery incorporated therein, which is contained in the cradle provided with charging means as another embodiment of the present invention, observed from the backside thereof.

FIG. 8 is a perspective view that shows the printer in accordance with another embodiment described above, observed diagonally above from the printer backside and printer ceiling face side as well.

As shown in FIG. 8, on the backside of the ink jet printer 800, there is arranged the contact point portion 910 of the cradle 950 for making electrical connection with the contact terminal portion 958. Then, the ink jet printer 800 having a battery (not shown) incorporated therein is directly contained in the cradle 950, which is provided with charging means (the same structure as shown in FIG. 5). In this manner, it becomes possible to charge the aforesaid battery. Also, the structure is arranged so as to make it possible to recognize by eyesight the charging indication unit 909 on the backside of the ceiling face of the ink jet printer 800 through the window 951*a* provided for the upper case 951 of the cradle 950, thus recognizing the charging condition of the battery while the ink jet printer 800 is contained in the cradle 950 as it is. Further, when the user contains the ink jet printer 800 in the cradle 950 in any direction, forward or backward, it is made possible to recognize the charging indication unit 909 through the window 951*a*, and to electrically connect the contact point portion 910 on the backside of the ink jet printer 800 with the contact terminal portion 958 of the cradle 950. Also, in place of the ink jet printer having the battery incorporated therein, the structure may be arranged to use an ink jet printer having a battery and charging means incorporated therein. Even in this case, the printer structure is the same as FIG. 8, and the structure of the cradle that contains such printer is the same as FIG. 5.

Further, for this printer of another embodiment, it is of course possible to adopt appropriately the structure described in conjunction with FIG. 1 to FIG. 7, and FIG. 9 before the description of such another embodiment.

Also, as obvious from the descriptions that have been made so far, the present invention is particularly preferable for a thin type image forming apparatus having a thickness of 3 inches or less, which demonstrates excellent portability but lacks stability when it is placed vertically.

As described above, in accordance with the present invention, it is possible to provide an image forming apparatus, which can be used in a mode of horizontal placement when images are formed, and also, in a mode of vertical placement with the aforesaid container stand having the apparatus contained therein when it is not in use. Further, it is made possible to charge the image forming apparatus in the status where it is contained in the container stand. Therefore, it is made possible to provide the image forming apparatus excellent in operability at the time of storage and charging battery as well, in addition to the advantages that it is thin and battery-driven, and suitable for portable use.

What is claimed is:

1. An image forming apparatus comprising:

a battery for driving the image forming apparatus; and charging means for charging the battery, wherein the charging means being mounted to the image forming apparatus and having a plurality of contact point portions, wherein the image forming apparatus being containable in a separate container stand, the battery is charged by containing the image forming apparatus in the container stand and the container stand having a plurality of contact terminal portions, wherein at least two of said plurality of contact point portions are conducted with a predetermined polarity in the inside of the charging means and said plurality of contact point portions are arranged in a symmetrical mode, wherein each of said plurality of contact point portions is in contact with each of the contact terminal portions having the predetermined polarity in a predetermined combination to charge the battery when the image forming apparatus is contained in the container stand in a predetermined direction, and each of said plurality of contact point portions is in contact with each of the contact terminal portions having the predetermined polarity in a combination other than the predetermined combination to charge the battery when the image forming apparatus is contained in the container stand in a direction different from the predetermined direction, wherein the contact point portions other than at least two of the plurality of contact point portions are conducted with a polarity different from the predetermined polarity.

2. An image forming apparatus comprising:

a battery for driving the image forming apparatus; and charging means for charging the battery, wherein the charging means being mounted to the image forming apparatus and having a plurality of contact point portions, wherein the image forming apparatus being containable in a separate container stand, the battery is charged by containing the image forming apparatus in the container stand and the container stand having a plurality of contact terminal portions, wherein at least two of said plurality of contact terminal portions are conducted with a predetermined polarity in the inside of the container stand and said plurality of contact terminal portions are arranged in a symmetrical mode, wherein each of said plurality of contact terminal portions is in contact with each of the contact point portions having the predetermined polarity in a predetermined combination to charge the battery when the image forming apparatus is contained in the container stand in a predetermined direction, and each of said plurality of contact terminal portions is in contact with each of the contact point portions having the predetermined polarity in a combination other than the predetermined combination to charge the battery when the image forming apparatus is contained in the container stand in a direction different from the predetermined direction, wherein the contact point portions other than at least two of the plurality of contact point portions are conducted with a polarity different from the predetermined polarity.

* * * * *